US007303217B2

(12) United States Patent
Savant

(10) Patent No.: US 7,303,217 B2
(45) Date of Patent: Dec. 4, 2007

(54) DOOR HANDLE, ESPECIALLY FOR VEHICLE, PROVIDED WITH AN INERTIAL SECURITY SYSTEM

(75) Inventor: Fiorenzo Savant, Collegno (IT)

(73) Assignee: Valeo Sicurezza Abitacolo SpA, Pianezza (IT)

( * ) Notice: Subject to any disclaimer, the term of this patent is extended or adjusted under 35 U.S.C. 154(b) by 127 days.

(21) Appl. No.: 10/532,335

(22) PCT Filed: Oct. 21, 2003

(86) PCT No.: PCT/EP03/50737

§ 371 (c)(1),
(2), (4) Date: Apr. 22, 2005

(87) PCT Pub. No.: WO2004/042177

PCT Pub. Date: May 21, 2004

(65) Prior Publication Data

US 2006/0163887 A1 Jul. 27, 2006

(30) Foreign Application Priority Data

Oct. 23, 2003 (IT) ..... MI2002A2250

(51) Int. Cl.
*E05B 3/00* (2006.01)
*E05C 65/10* (2006.01)

(52) U.S. Cl. ..... 292/336.3; 292/92; 292/DIG. 22; 292/DIG. 65; 16/412

(58) Field of Classification Search ..... 292/336.3, 292/92, 347, DIG. 22, DIG. 65; 16/412
See application file for complete search history.

(56) References Cited

U.S. PATENT DOCUMENTS

| | | | | |
|---|---|---|---|---|
| 3,719,248 | A * | 3/1973 | Breitschwerdt et al. | 180/271 |
| 5,669,642 | A * | 9/1997 | Kang | 292/336.3 |
| 6,007,122 | A | 12/1999 | Linder et al. | |
| 6,042,159 | A | 3/2000 | Spitzley et al. | |
| 6,367,295 | B1 * | 4/2002 | Agostini et al. | 70/257 |
| 6,588,813 | B1 * | 7/2003 | Marcarini et al. | 292/347 |
| 7,029,042 | B2 * | 4/2006 | Belchine, III | 292/336.3 |
| 2002/0059693 | A1 | 5/2002 | Jooss et al. | |

FOREIGN PATENT DOCUMENTS

| | | | |
|---|---|---|---|
| DE | 19858416 | * | 6/2000 |
| DE | 199 10 513 A1 | | 9/2004 |
| EP | 1 010 846 A1 | | 6/2000 |
| EP | 1 128 004 A2 | | 8/2001 |

* cited by examiner

*Primary Examiner*—Carlos Lugo
(74) *Attorney, Agent, or Firm*—Berenato, White & Stavish

(57) ABSTRACT

A handle for a motor vehicle door comprising a lever that can rotate about a first axis in a frame that is fixed to the door and is connected mechanically to a rocker wheel that rotates in the frame about a second axis when the stop piece belonging to a locking member comprising a pendulum that has lever is pulled in order to unlock the door, the rocker wheel is provided with a shoulder capable of being intercepted by a an inertial mass and is hinged to the frame or to a body integral therewith so as to pivot about a third axis, that during a violent pivoting of the pendulum, the stop piece strikes the shoulder and prevents the rocker wheel from rotating.

15 Claims, 6 Drawing Sheets

DOOR HANDLE, ESPECIALLY FOR VEHICLE, PROVIDED WITH AN INERTIAL SECURITY SYSTEM

The present invention relates to a handle for a door or the like, and in particular a lever handle that can be used to unlock and simultaneously open the door of a motor vehicle and is provided with an inertial safety device that prevents accidental opening of this door in the event of an accident.

Patent application EP 1 128 004 in the name of the same Applicant discloses a handle comprising a lever that can rotate in a frame to be fixed to a door and is connected mechanically to a rocker wheel that can rotate in the frame when the lever is pulled in order to unlock the door, the said rocker wheel being provided with a shoulder capable of being intercepted by a stop piece belonging to a locking member comprising a pendulum provided with an inertial mass, in such a way that the stop piece strikes the shoulder during a violent pivoting of the pendulum caused by inertial forces acting on this mass. With this arrangement the handle, and therefore the door, cannot come open accidentally because of the inertial forces acting on the lever during an impact on the motor vehicle.

However, the locking member of this known handle does not always work properly when inertial forces are applied in certain directions, because, in order to keep the design simple, the locking member has always been located in peripheral areas of the handle and is therefore distant from the centre of gravity of the lever. This means that the forces acting on the inertial mass may sometimes be different from those acting from the lever.

It is therefore an object of the present invention to provide a handle that does not have this drawback. The said object is achieved by means of a handle whose main features are as specified in the first claim and whose other features are as specified in the other claims.

Because of the particular arrangement of the pendulum and of its axis of rotation, the handle locking member according to the present invention experiences the same inertial forces as the lever. This means that it is able to lock the lever very quickly before it is rotated by these forces, whatever their direction.

One particular aspect of the invention is that the inertial mass of the pendulum is flat and is located close to the centre of the frame, to improve its sensitivity to the inertial forces acting on the handle lever.

Another aspect of the invention is that the pendulum is pivoted by a tappet and by a corresponding cam surface on the rocker wheel whenever the lever is pulled to open the door. This arrangement ensures that the pendulum does not remain immobile during normal use of the motor vehicle, which could allow dirt to build up, leading to failure of the device in the event of an accident. Furthermore, the pivoting of the pendulum can be exploited to activate operating devices, such as the automatic lock release device, as a means of circumventing it in the event of failure, or turning on the interior lights of the motor vehicle.

Lastly, due to the particular parts of which it is made up, the handle according to the present invention is also simple and inexpensive to manufacture, as well as compact.

Other advantages and features of the handle according to the present invention will become clear to those skilled in the art in the following detailed and non-limiting description of two embodiments thereof, referring to the accompanying drawings, in which.

Figure 1:
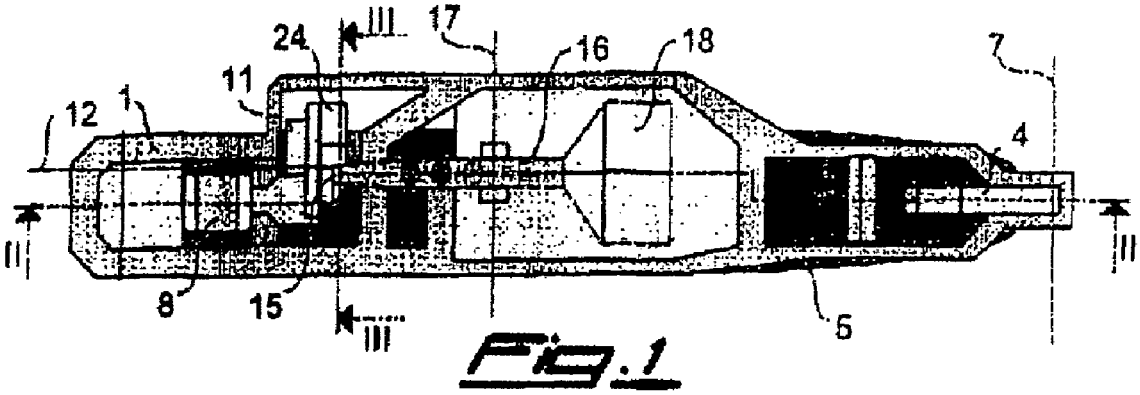
FIG. 1 is a side view of the handle in the first embodiment of the invention in the rest position.
Figure 2:
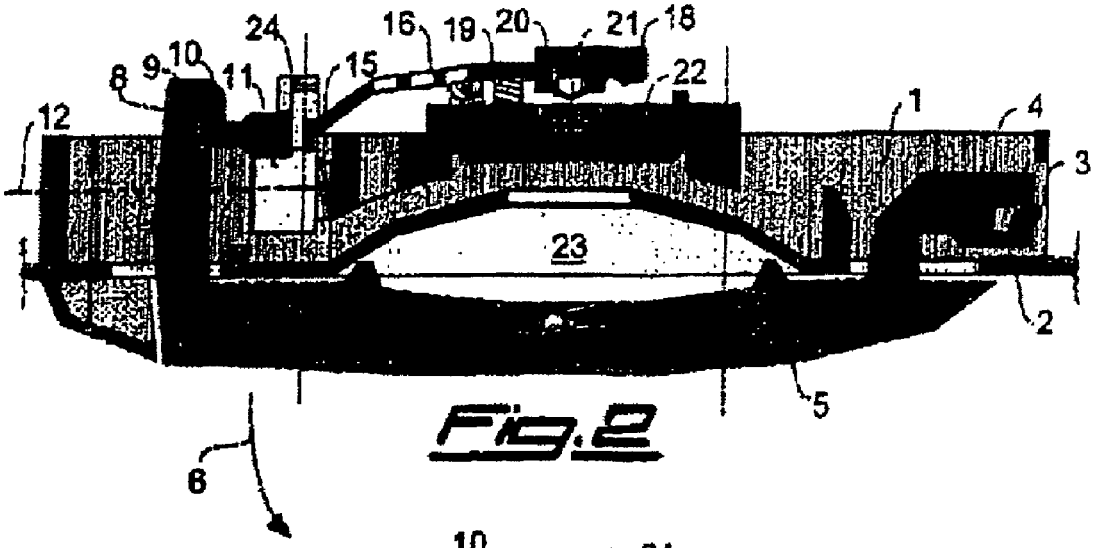
FIG. 2 shows a cross section taken on the plane II—II of the handle seen in FIG. 1.
Figure 3:
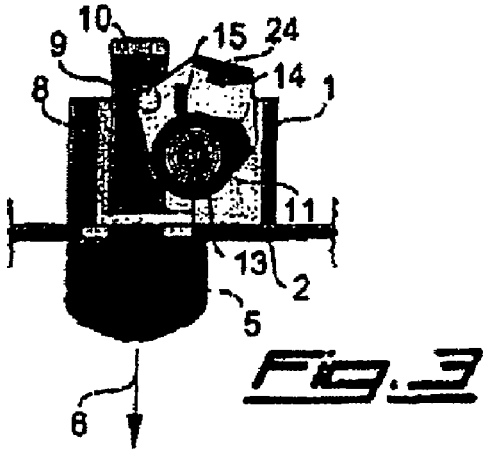
FIG. 3 shows a cross section taken on the plane III—III of the handle seen in FIG. 1.

Referring to FIGS. 1 to 3, it can be seen that the handle according to the first embodiment of the invention comprises, as in the prior art, a frame 1 capable of being fixed for example behind the outer surface of a door 2 (shown only partly in FIGS. 2 and 3) of a motor vehicle. The frame 1 is provided with a transverse pin 3 acting as a fulcrum, about which a shaped extension 4 connected to one end of a lever 5 can rotate. The lever 5 can be pulled outwards in the direction of arrow 6 to open the door 2. The lever 5 therefore rotates about a first axis 7 that is essentially parallel to the axis of rotation of the door 2. The other end of the lever 5 is provided with an appendage 8 which projects into the frame 1 and comprises a recess 9 in which a tongue 10 is rotatably engaged. This tongue projects from one side of a rocker wheel 11 which can rotate in the frame 1 about a second axis 12 essentially perpendicular to the axis 7. With this arrangement, the lever 5 is connected mechanically to the rocker wheel 11 in such a way that the latter rotates about the axis 12 when the lever 5 is pulled. A helical spring 13 is located coaxially in the rocker wheel 11 to return it to its original position, together with the lever 5, when the latter is no longer being pulled. The rocker wheel 11 in turn is connected to the unlocking mechanism (not shown in the figures) of the door 2, in such a way that the latter can be opened by pulling the lever 5 further out. This connection is provided for example by a cable (not shown in the figures) which is pulled by the rocker wheel 11 during its rotation.

According to the invention, the rocker wheel 11 is preferably provided with a cam surface 14 on which there can slide a tappet 15 at one end of the arm of a locking member comprising in particular a pendulum 16 hinged to the frame 1 or to a body integral with this frame. The pendulum 16 therefore pivots about a third axis 17 essentially parallel to the axis 7 about which the lever 5 rotates when the rocker wheel 11 rotates about the axis 12. The other end of the pendulum 16 is provided with an inertial mass 18 which is preferably of a flat shape and is located close to the centre of the frame 1, between the axes 7 and 17, in such a way that the inertial mass 18 is essentially parallel to these axes, while a straight line passing through the centres of gravity of the inertial mass 18 and of the lever 5 is essentially perpendicular to these.

Elastic means 19, in particular a helical spring located between the pendulum 16 and the frame 1, press the tappet 15 against the cam surface 14 of the rocker wheel 11. When the tappet 15, sliding over the cam surface 14, moves away from the centre of the rocker wheel 11, a shoe 20 underneath the inertial mass 18 presses against a switch 21 of a control device 22 housed in a seat formed in the frame 1. The shoe 20 is preferably mounted on elastic means, such as a helical spring, to reduce the pressure, if excessive, on the switch 21. The control device 22 is an electrical and/or electronic device that sends a signal to verify the proximity of a coded transceiver acting as a key to open the lock of the door 2 automatically when the presence of an opaque body, such as the hand of a user, is detected in the space 23 between the lever 5 and the door 2. In the present embodiment of the invention this signal is then sent, to enhance the reliability of the said automatic device, even when the shoe 20 presses on the switch 21, that is when the lever 5 is pulled. The switch 21 can also be connected directly to the lock of the door 2 and/or control the operation of other devices, such as the interior lights of the motor vehicle.

The rocker wheel 11 is suitably provided with a shoulder 24 located at a distance from the cam surface 14 that is greater than the height of the tappet 15 of the pendulum 16. The tappet 15 therefore passes underneath the shoulder 24 without touching it if it slides over the cam surface 14, but strikes it, thus acting as a stop piece and preventing the rocker wheel 11 from rotating, when it comes off this surface owing in particular to a violent pivoting of the pendulum 16.

Figure 4:
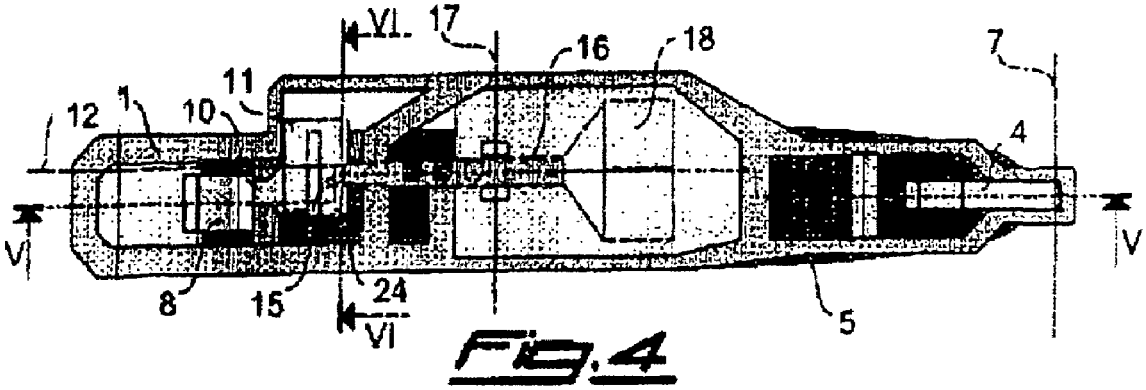
FIG. 4 is a side view of the handle seen in FIG. 1 in the open position.
Figure 5:
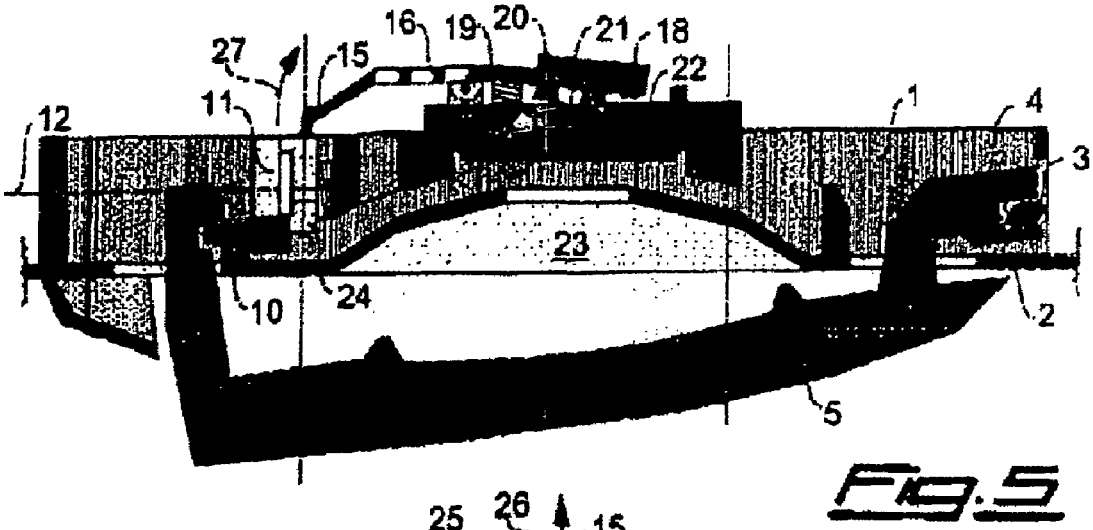
FIG. 5 shows a cross section taken on the plane V—V of the handle seen in FIG. 4.
Figure 6:
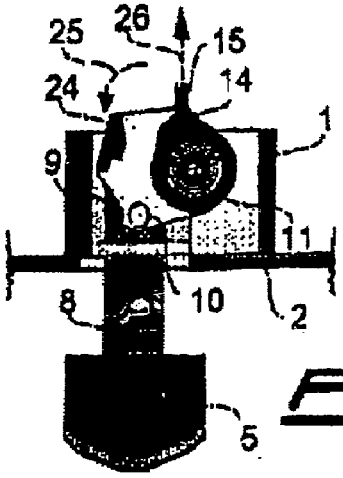
FIG. 6 shows a cross section taken on the plane VI—VI of the handle seen in FIG. 4.

Referring now to FIGS. 4 to 6, it can be seen that, in normal use, when the lever 5 is pulled manually in the direction of arrow 6, the rocker wheel 11 rotates in the direction of arrow 25, so that the tappet 15, sliding over the cam surface 14, moves in the direction of arrow 26, causing the pendulum 16 to pivot in the direction of arrow 27. The pivoting of the pendulum 16 also throws the switch 21, so as to activate the devices connected to it, for example opening the door 2 lock and/or turning on the interior lights of the motor vehicle.

Figure 7:
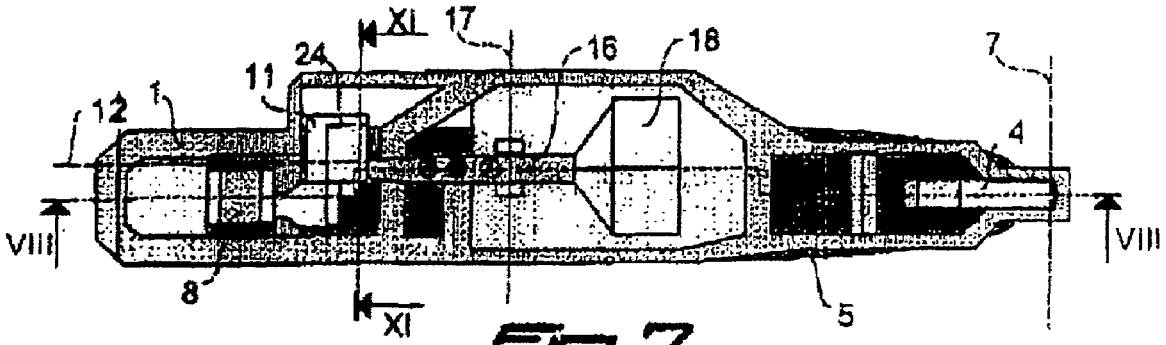
FIG. 7 is a side view of the handle seen in FIG. 1 in an impact position.
Figure 8:
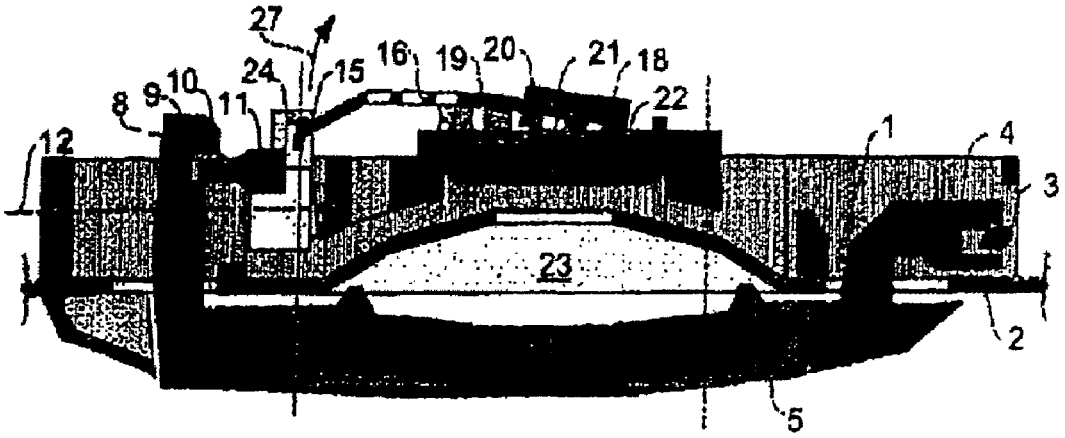
FIG. 8 shows a cross section taken on the plane VIII—VIII of the handle seen in FIG. 7.
Figure 9:
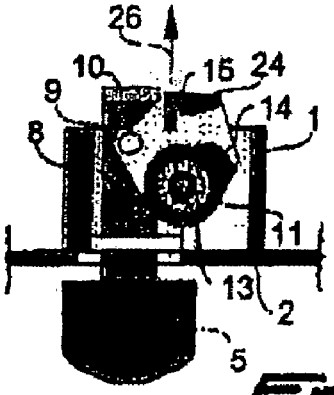
FIG. 9 shows a cross section taken on the plane IX—IX of the handle seen in FIG. 7.

Referring now to FIGS. 7 to 9, it can be seen that, in the event of an accident, if the lever 5 experiences a force that would tend to open it in the direction of arrow 6, the inertial mass 18 will also experience the same force, so that the pendulum 16 will pivot, overcoming the force of the spring 19, causing the tappet 15 to come off the cam surface 14 in the direction of arrow 26. The tappet 15, in its new position, will intercept and lock the shoulder 24 at the beginning of the rotation of the rocker wheel 11 pulled by the lever 5, which will prevent it rotating any further. Being unable to turn any further, the rocker wheel 11 will not operate the door 2 unlocking mechanism, thus preventing its accidental opening. As before, the pivoting of the pendulum 16 operates the switch 21.

Figure 10:
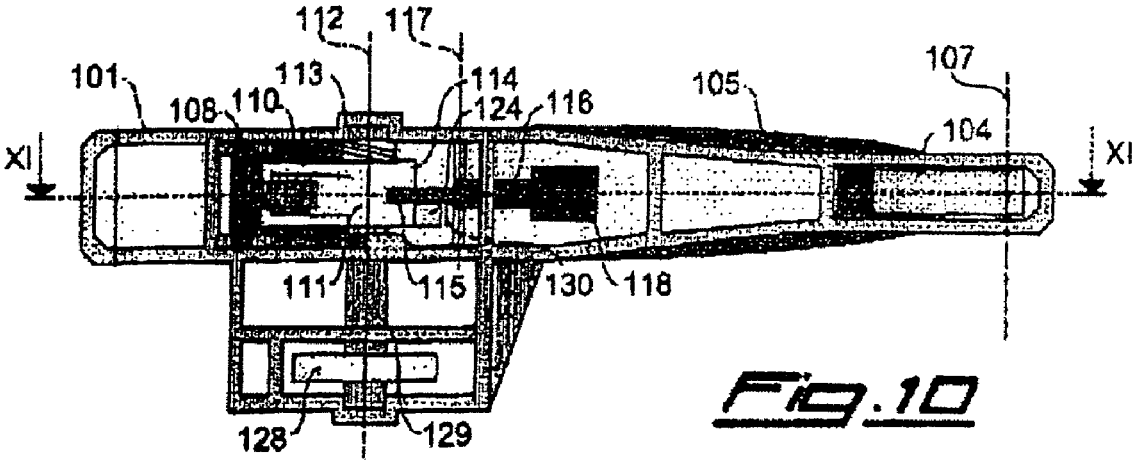
FIG. 10 is a side view of the handle in the second embodiment of the invention, in the rest position.
Figure 11:
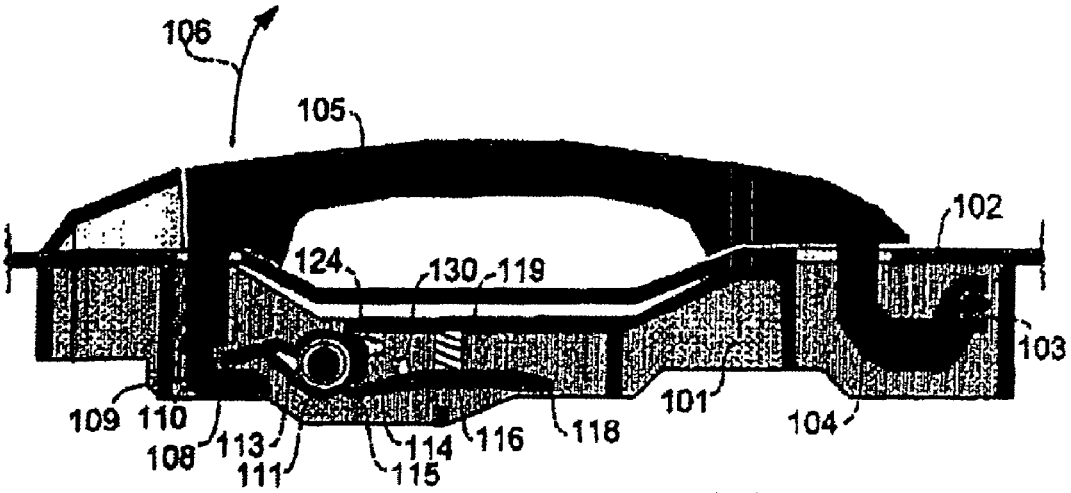
FIG. 11 shows a cross section taken on the plane XI—XI of the handle seen in FIG. 10.

Referring now to FIGS. 10 and 11, it can be seen that the handle according to the second embodiment of the invention still comprises a frame 101 capable of being fixed behind the outer surface of a door 102 of a motor vehicle. The frame 101 is provided with a fulcrum 103, about which a shaped extension 104 of a lever 105 can rotate. The lever 105 can be pulled outwards in the direction of arrow 106 and rotate about an axis 107 that is essentially parallel to the axis of rotation of the door 102. The lever 105 is provided with an appendage 108 that comprises a recess 109 in which a tongue 110 of a rocker wheel 111 is rotatably engaged. When the lever 105 is pulled, the rocker wheel 111 rotates in the frame 101 about an axis 112 that is essentially parallel to the axis 107 and not perpendicular to it as in the first embodiment. A helical spring 113 is located coaxially in the rocker wheel 111 to return it to its original position, together with the lever 105, when the latter is no longer being pulled. The rocker wheel 111 operates the unlocking mechanism of the door 102 via a cable (not shown in the figures) which is pulled by an oval pulley 128. The latter is connected to the rocker wheel 111 by a shaft 129 so as to rotate with it about the axis 112.

According to the invention, the rocker wheel 111 is also preferably provided with a cam surface 114 on which there can slide a tappet 115 at one end of the arm of a pendulum 116 hinged to the frame 101 or to a body integral with this frame. In this embodiment too, therefore, the pendulum 116 pivots about an axis 117 essentially parallel to the axis 107 about which the lever 105 rotates. The other end of the pendulum 116 is provided with an inertial mass 118 which is of a flat shape and is located close to the centre of the frame 101, between the axes 107 and 117, in such a way that the inertial mass 118 is essentially parallel to these axes, while a straight line passing through the centres of gravity of the inertial mass 118 and of the lever 105 is essentially perpendicular to these.

Elastic means 119, in particular a helical spring located between the pendulum 116 and the frame 101, press the tappet 115 against the cam surface 114 of the rocker wheel 111. The rocker wheel 111 is suitably provided with a shoulder 124 extending towards a corresponding stop piece 130 that projects from the pendulum 116. The shoulder 124 passes close to the stop piece 130 without touching it if the tappet 115 slides over the cam surface 114, but strikes it, thus preventing the rocker wheel 111 from rotating, when the tappet 115 comes off this surface, for example owing to a violent pivoting of the pendulum 116.

Figure 12:
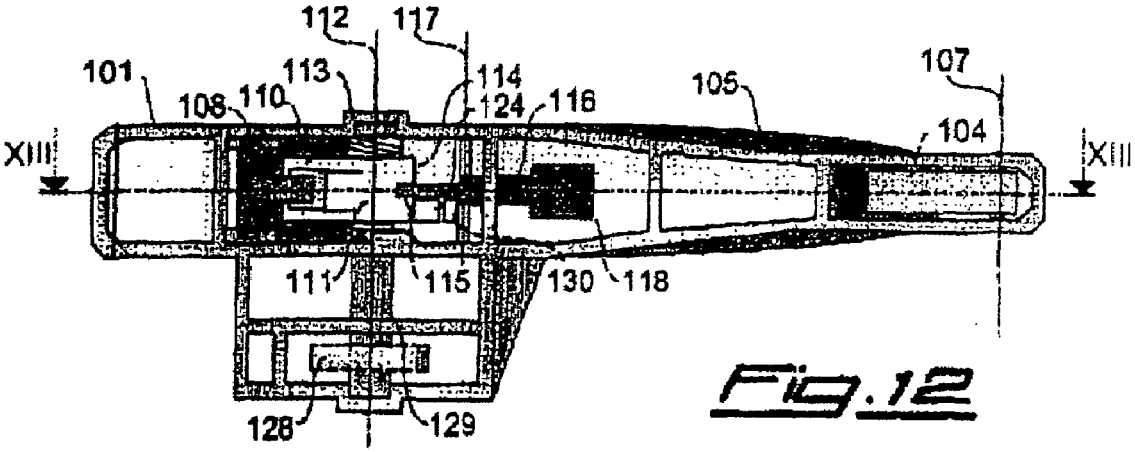
FIG. 12 shows the handle seen in FIG. 10 in the open position.
Figure 13:
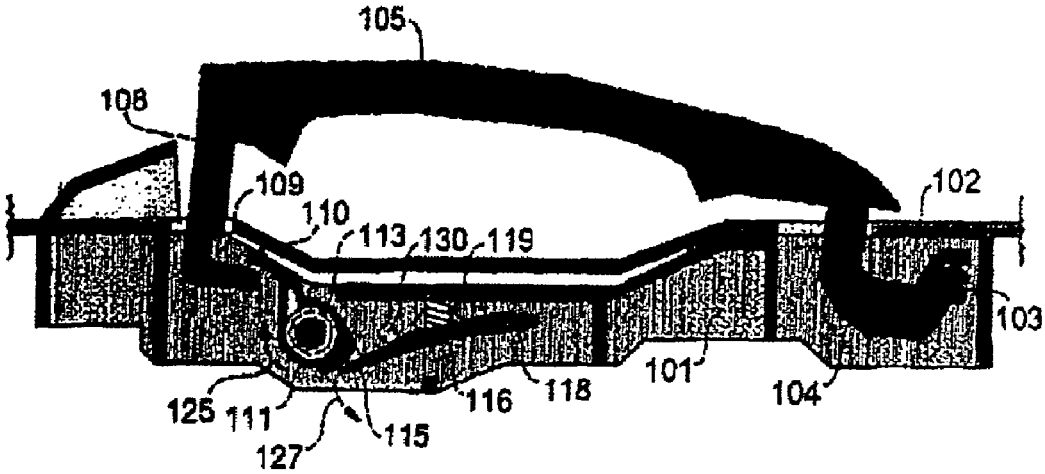
FIG. 13 shows a cross section taken on the plane XIII—XIII of the handle seen in FIG. 12.

Referring now to FIGS. 12 and 13, it can be seen that in normal use, when the lever 105 is pulled manually in the direction of arrow 106, the rocker wheel 111 rotates in the direction of arrow 125, so that the tappet 115, sliding over the cam surface 114, moves and causes the pendulum 116 to pivot in the direction of arrow 127.

Figure 14:
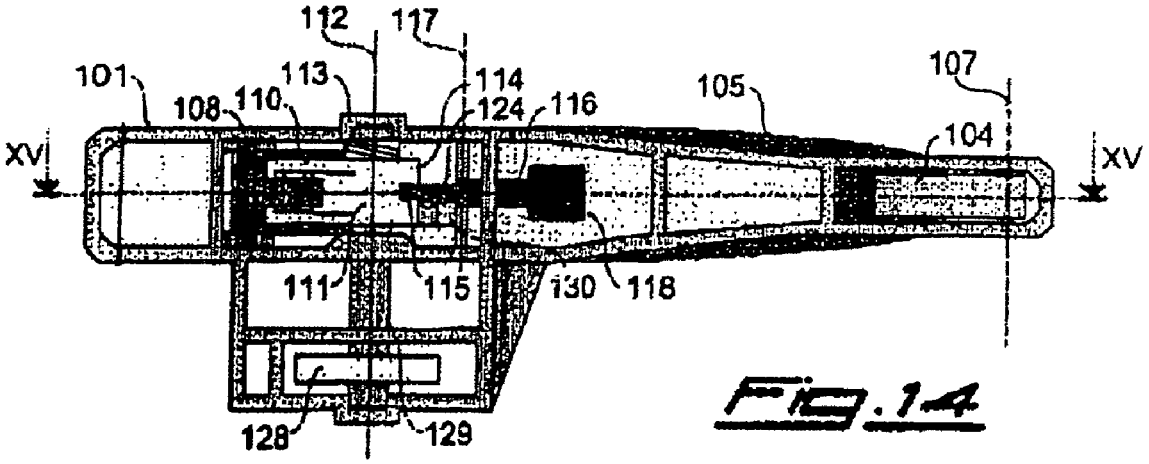
FIG. 14 shows the handle seen in FIG. 10 in an impact position.
Figure 15:
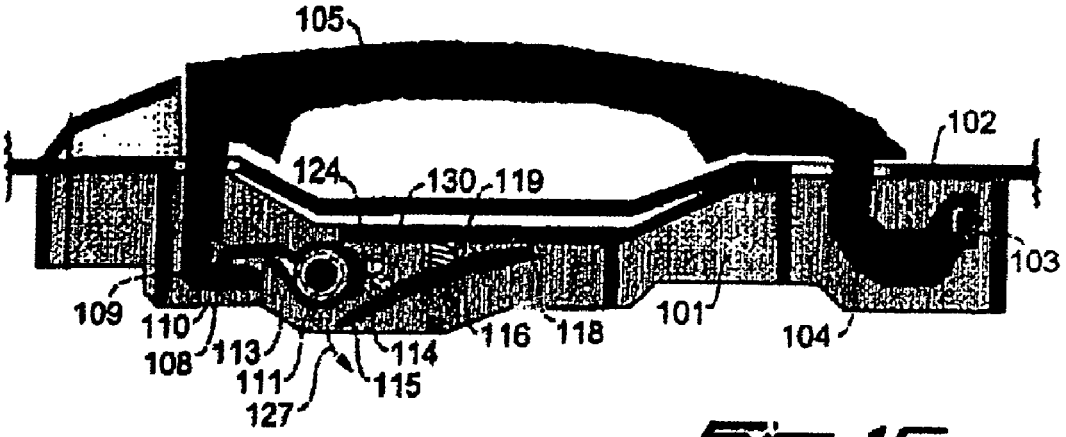
FIG. 15 shows a cross section taken on the plane XV—XV of the handle seen in FIG. 14.

Referring now to FIGS. 14 and 15, it can be seen that, in the event of an accident, if the lever 105 experiences a force that would tend to open it in the direction of arrow 106, the inertial mass 118 will also experience the same force, so that the pendulum 116 will pivot, overcoming the force of the spring 119, causing the tappet 115 to come off the cam surface 114 in the direction of arrow 127 and moving the stop piece 130 towards the rocker wheel 111. The stop piece 130 of the pendulum 116, in its new position, intercepts and locks the shoulder 124 at the beginning of the rotation of the rocker wheel 111 pulled by the lever 105, which will prevent it rotating any further.

Other variants and/or additions may be made by those skilled in the art to the embodiments of the invention described and illustrated herein while remaining within the scope of the said invention.

The invention claimed is:

1. Handle for a motor vehicle door (2; 102) comprising a lever (5; 105) that can rotate about a first axis (7; 107) in a frame (1; 101) to be fixed to the door (2; 102) and is connected mechanically to a rocker wheel (11; 111) that can rotate in the frame (1; 101) about a second axis (12; 112) when the lever (5; 105) is pulled in order to unlock the door (2; 102), said rocker wheel (11; 111) being provided with a shoulder (24; 124) capable of being intercepted by a stop piece (15; 130) belonging to a locking member comprising a pendulum (16; 116) which is provided with an inertial mass (18; 118) and is hinged to the frame (1; 101) or to a body integral therewith so as to pivot about a third axis (17; 117), in such a way that during a violent pivoting of the pendulum (16; 116) the stop piece (15; 130) strikes the shoulder (24; 124) and prevents the rocker wheel (11; 111) from rotating, wherein said third axis of rotation (17; 117) of the pendulum (16; 116) is essentially parallel to said first axis of rotation (7; 107) of the lever (5; 105), and wherein said inertial mass (18; 118) is located between said first and third axes of rotation (7, 17; 107; 117).

2. Handle according to claim 1, characterized in that said inertial mass (18; 118) is located close to a center of the frame (1; 101).

3. Handle according to claim 1, characterized in that a straight line passing through the centres of gravity of the inertial mass (18; 118) and of the lever (5; 105) is essentially perpendicular to the first (7; 107) and third (17; 117) axes of rotation.

4. Handle according to claim 1, characterized in that this inertial mass (18; 118) is of a flat shape.

5. Handle according to claim 4, characterized in that this inertial mass (18; 118) is essentially parallel to the first (7; 107) and third (17; 117) axes of rotation.

6. Handle according to claim 1, characterized in that the first axis of rotation (7; 107) is essentially parallel to the axis of rotation of the door (2).

7. Handle according to claim 1, characterized in that the second axis of rotation (12) is essentially perpendicular to the first (7) and third (17) axes of rotation.

8. Handle according to claim 1, characterized in that the second axis of rotation (112) is essentially parallel to the first (107) and third (117) axes of rotation.

9. Handle according to claim 1, characterized in that the rocker wheel (11; 111) is provided with a cam surface (14; 114) on which a tappet (15; 115) integral with the pendulum (16; 116) can slide, in such a way that the pendulum pivots when the rocker wheel (11; 111) rotates about the second axis (12; 112).

10. Handle according to claim 9, characterized in that the shoulder (24) of the rocker wheel (11) is located at a distance from the cam surface (14) that is greater than the height of the tappet (15) of the pendulum (16), so that the tappet (15) passes underneath the shoulder (24) without touching it if it slides over the cam surface (14), but strikes it, thus acting as a stop piece and preventing the rocker wheel (11) from rotating, when it comes off said cam surface.

11. Handle according to claim 9, characterized in that the shoulder (124) of the rocker wheel (111) extends towards a corresponding stop piece (130) that projects from the pendulum (116), in such a way that the shoulder (124) passes close to the stop piece (130) without touching it if the tappet (115) slides over the cam surface (114), but strikes it, thus preventing the rocker wheel (111) from rotating, when it comes off said cam surface.

12. Handle according to claim 1, characterized in that elastic means (19; 119) are arranged between the frame (1; 101) and the pendulum (16; 116) in order to press the pendulum (16: 116) against the rocker wheel (11; 111).

13. Handle according to claim 1, characterized in that when the pendulum (16) pivots about the third axis (17), it operates a switch (21) belonging to a control device (22) housed in a seat formed in the frame (1).

14. Handle according to claim 13, characterized in that the inertial mass (18) of the pendulum (16) is provided with a shoe (20) mounted on elastic means in order to press against said switch (21) of the control device (22) when the pendulum (16) pivots about the third axis (17).

15. Handle according to claim 13, characterized in that when said switch (21) is operated, the control device (22) sends a signal to open the lock of the door (2) and/or operate other devices, such as the interior lights of the motor vehicle.

* * * * *